US010017932B2

(12) United States Patent
Mehari

(10) Patent No.: US 10,017,932 B2
(45) Date of Patent: Jul. 10, 2018

(54) TOILET SEAL

(71) Applicant: HASE LLC, Chicago, IL (US)

(72) Inventor: Abel Mehari, Chicago, IL (US)

( * ) Notice: Subject to any disclaimer, the term of this patent is extended or adjusted under 35 U.S.C. 154(b) by 0 days.

(21) Appl. No.: 15/135,301

(22) Filed: Apr. 21, 2016

(65) Prior Publication Data

US 2016/0312458 A1 Oct. 27, 2016

Related U.S. Application Data

(60) Provisional application No. 62/150,844, filed on Apr. 21, 2015.

(51) Int. Cl.
*E03D 11/16* (2006.01)

(52) U.S. Cl.
CPC ..... *E03D 11/16* (2013.01)

(58) Field of Classification Search
CPC ..... E03D 11/16; E03D 11/13; E03D 11/135; E03D 11/14; E03D 11/143; E03D 11/146; E03D 11/17
USPC ..... 4/252.5, 252.6, 252.1
See application file for complete search history.

(56) References Cited

U.S. PATENT DOCUMENTS

| | | | | |
|---|---|---|---|---|
| 901,545 | A * | 10/1908 | Morrison | F16L 47/32 285/125.1 |
| 5,185,890 | A * | 2/1993 | Dismore | E03D 11/16 4/252.1 |
| 6,519,784 | B2 * | 2/2003 | Carwile | E03D 11/16 4/252.1 |
| 2002/0023294 | A1 * | 2/2002 | Spells, Sr. | E03D 11/16 4/252.6 |
| 2014/0062035 | A1 * | 3/2014 | Coronado | E03D 11/16 277/607 |
| 2015/0292190 | A1 * | 10/2015 | Coronado | E03D 11/16 4/252.6 |
| 2017/0114533 | A1 * | 4/2017 | Schuster | E03D 11/16 |

FOREIGN PATENT DOCUMENTS

| | | | |
|---|---|---|---|
| JP | 4-52332 | * | 2/1992 |

* cited by examiner

*Primary Examiner* — J. Casimer Jacyna
(74) *Attorney, Agent, or Firm* — AU LLC; Adam E. Urbanczyk

(57) ABSTRACT

Provided is an improved toilet seal that utilizes redundant and adaptable physical barriers to facilitate installation and improve sealing performance at the junction between a toilet base and floor.

2 Claims, 5 Drawing Sheets

TOILET SEAL

FIELD OF THE INVENTION

This invention generally relates to plumbing fixtures and, in particular, gasket-type systems for use with plumbing fixture (e.g., toilet) installations.

BACKGROUND OF THE INVENTION

While toilet plumbing technology has evolved over hundreds of years, common problems continue to include those arising with the installation, use, and removal of toilets onto bathroom floor-located pipes and flanges engaged thereto. Professional plumbers routinely complain that current toilet seals, despite being used in conjunction with bolts, flanges, and mating brackets, allow for wobbling that eventually leads to compromised seals and leakage.

At its most basic, installing a toilet onto a floor involves mating the toilet base outlet to a soil pipe that is built into the floor. The toilet is secured in place onto the floor, usually by means of a flange built into the floor surface, to prevent the toilet's base outlet from disaligning with the soil pipe. A gasket of some type—e.g., a wax ring—is often disposed between the toilet base outlet and soil pipe to ensure that solid, liquid, and gaseous toilet contents do not permeate the toilet base outlet and soil pipe mating junction.

Where the gasket's integrity is compromised, toilet contents may permeate the base outlet and soil pipe mating junction and into the floor. Where the gasket is simply a ring made of wax or other inelastic polymer, the risk that the gasket is compromised during installation or removal increases.

Some toilet seal gaskets incorporate a ring of wax or semi-soft material disposed within a polymer sleeve. The sleeve, which is inserted into the soil pipe during installation, may incorporate a series of baffles annularly arranged along the outer length of the sleeve. While this helps maintain the attachment of the inner surface of the soil pipe to the gasket, such baffling does not make the overall junction between the toilet base outlet and soil pipe any more secure.

One such device is depicted in U.S. Pat. No. 5,185,890 entitled "Toilet Bowl Sealing Assembly." Depicted there is, among other assembly components, a first flange with a single "centering funnel" that creates a single volume from the toilet to the drain pipe and through which waste water passes. The integrity of the seal depends entirely on the second flange, into which the first flange is inserted, that is mechanically fastened to the toilet and the floor. The series of concentric flanges depicted in U.S. Pat. No. 5,185,890 is designed to secure the toilet to the floor, and not to create any seal redundancy.

Invariably, modern toilet seals act to create a single continuous volume from the toilet base outlet and into the soil pipe, using a single gasket to create the seal. In the event the integrity of the gasket is compromised, there is no redundantly sealed volume to contain any escaping solid, liquid, or gaseous toilet contents.

BRIEF SUMMARY OF THE INVENTION

The present invention is an improved toilet seal that incorporates a flexible sleeve with a cylindrical distal end and proximal end that expands into a first stage and a second stage. A circular channel-shaped gasket is disposed within the inner surface of the first stage. A flattened ring-shaped gasket is disposed around the top surface of the second stage. A bottom surface of a toilet outlet is mated to the channel-shaped gasket forming a first fluid volume. The flattened ring-shaped gasket is mated to a second surface of the toilet outlet forming a second (i.e., redundant) fluid volume.

BRIEF DESCRIPTION OF THE DRAWINGS

The accompanying figures and drawings, incorporated into and forming part of the specification, service to further illustrate the present invention, its various principles and advantages, and its varying embodiments.

DETAILED DESCRIPTION

Figure 1:
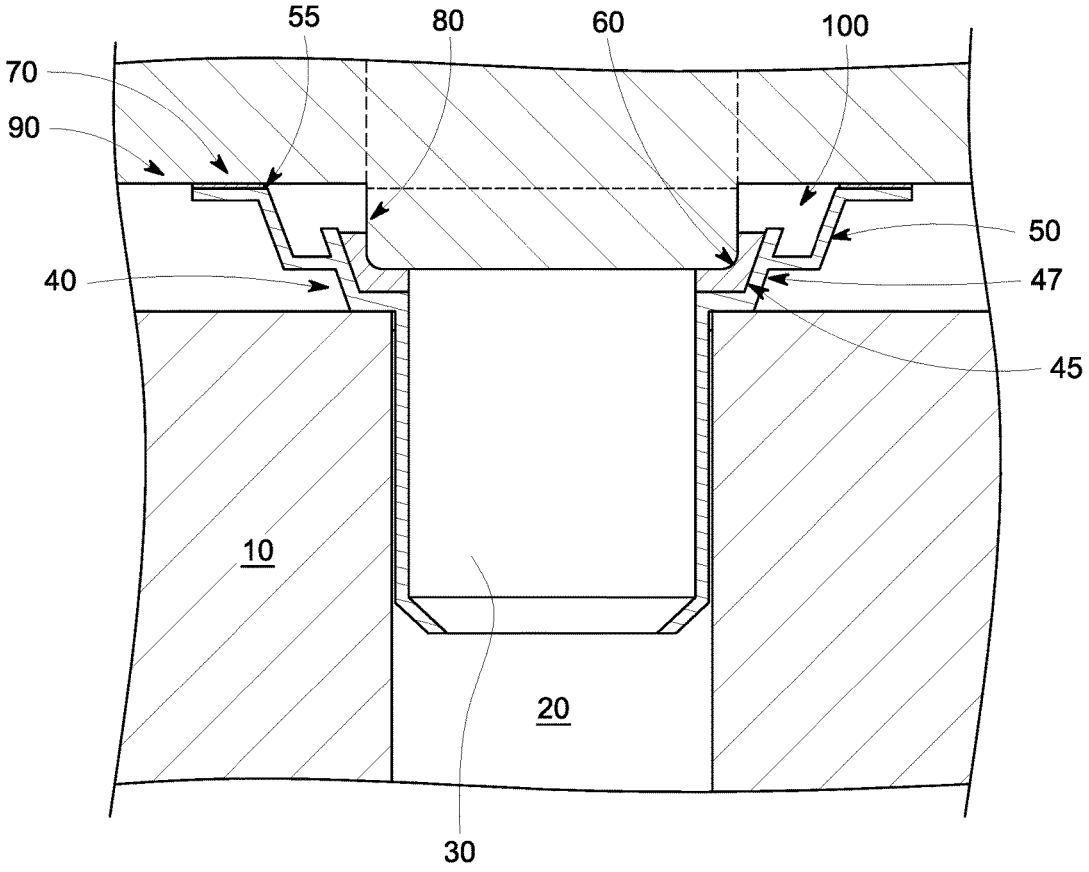
FIG. 1 depicts a cross sectional side view of an exemplary improved toilet seal as-installed between a toilet and flooring.

Provided is an improved toilet seal that creates redundant sealing of a toilet outlet/soil pipe junction. Turning to the figures, FIG. 1 illustrates, in cross sectional fashion, one embodiment of the invention as-installed between a toilet outlet 80 and a floor 10. This embodiment incorporates a sleeve the distal portion 30 of which is inserted into the soil pipe 20 existing within the floor 10. The toilet outlet 80 engages a channel-shaped gasket 60 immediately above the distal portion of the sleeve 30. The channel-shaped gasket 60 can be made for a variety of elastomeric, adhesive, silicone, wax, cellulose, cork, rubber, and other pliable materials. The channel-shaped gasket 60 is disposed within an inner surface 45 of a first stage 40. A second stage 50 extends from the outer surface 47 of the first stage. A ring-shaped gasket 70 is disposed on a top surface 55 of the second stage and self-adheres to a lower surface of the toilet 90. The ring-shaped gasket 70 can be made for a variety of elastomeric, adhesive, silicone, wax, cellulose, cork, rubber, and other pliable materials. This forms a chamber 100 between the channel-shaped gasket 60, the first stage 40, the second stage 50, the ring shaped gasket 70, and the lower surface of the toilet 90. The chamber 100 acts as a containment volume redundant to the contained volume existing between and through the soil pipe 20 and toilet.

Figure 2:
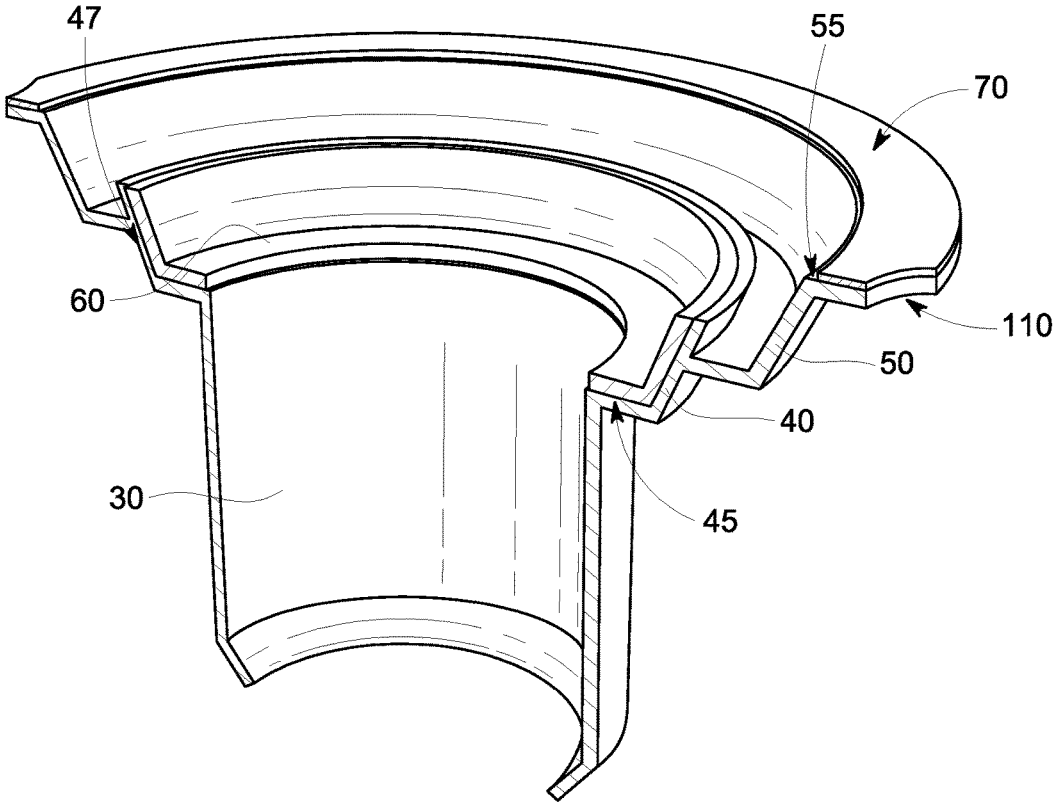
FIG. 2 depicts a cross sectional three-quarter view of an exemplary improved toilet seal.

FIG. 2 presents a three-quarter perspective view of the same embodiment' cross section. The channel-shaped gasket 60 is disposed within the inner surface 45 of the first stage 40 immediately above sleeve distal portion 30. The second stage 50 radially extends from the first stage 40. The ring-shaped gasket 70 is disposed onto the top surface 55 of the second stage 50. Appurtenances 110 are disposed along the second stage to facilitate installation.

Figure 3:
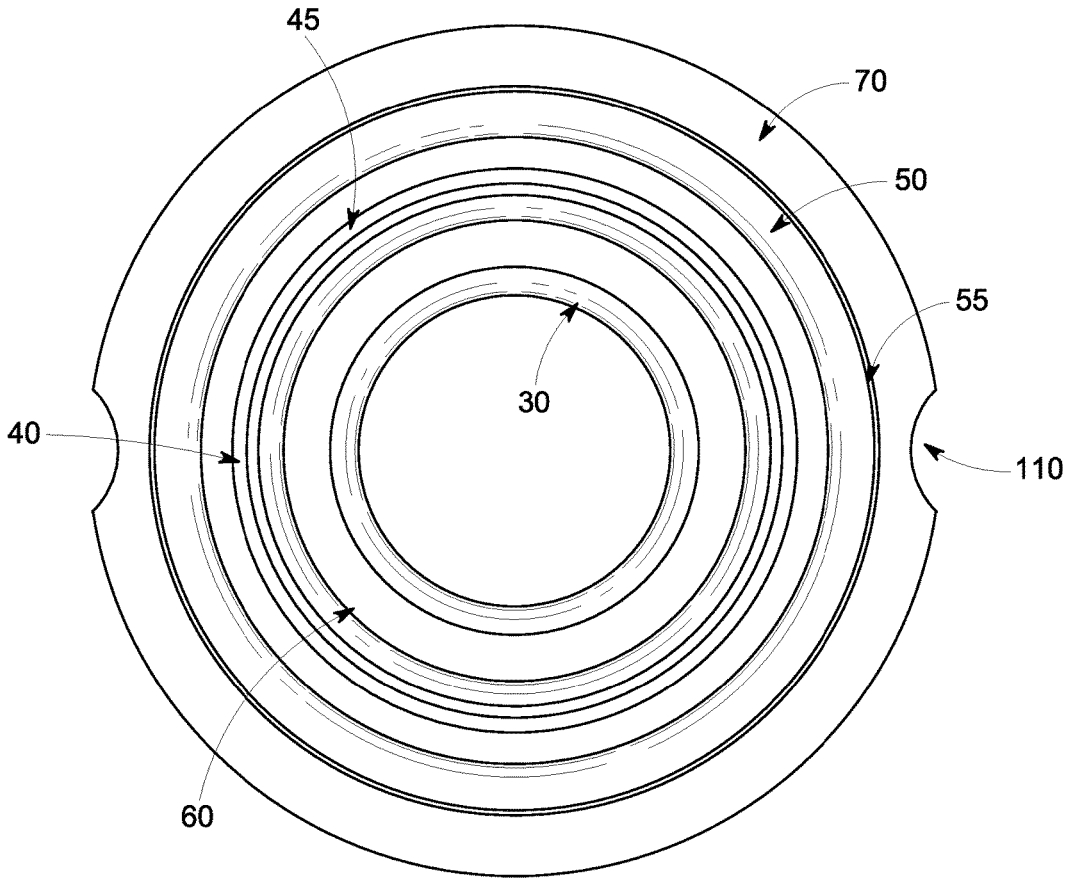
FIG. 3 depicts a top view of an exemplary improved toilet seal.

FIG. 3 presents a top view of the same embodiment. The channel-shaped gasket 60 is disposed within the inner surface 45 of the first stage 40, the first stage radially extending from the distal portion of the sleeve 30. Beneath the first stage 40 is the distal portion of the sleeve 30. The second stage 50 radially extends from the first stage 40. The ring-shaped gasket 70 is disposed onto the top surface 55 of the second stage. Appurtenances 110 are disposed along the second stage to facilitate installation.

Figure 4:
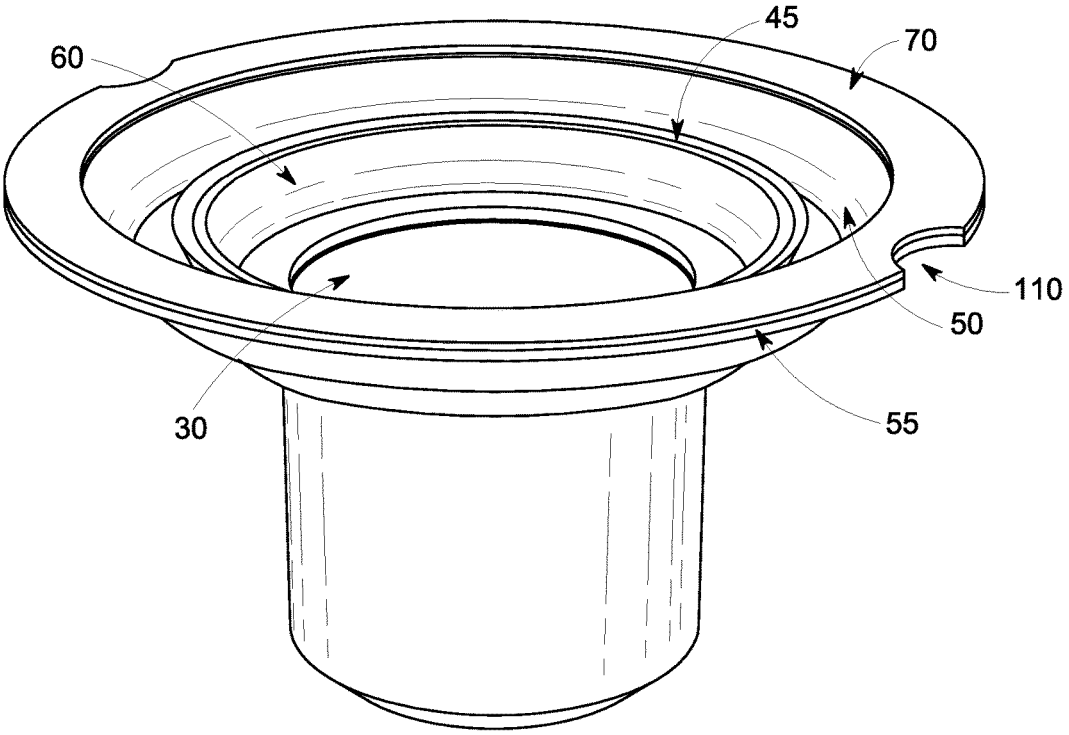
FIG. 4 depicts a three-quarter view of an exemplary improved toilet seal.

FIG. 4 presents an isometric view of the same embodiment. The channel-shaped gasket 60 is disposed within the inner surface 45 of the first stage and rests immediately above the distal portion of the sleeve 30. The second stage 50 radially extends and terminates in an upper surface 55 on which a ring shaped gasket 70 is disposed. Appurtenances 110 are disposed along the second stage to facilitate installation.

Figure 5:
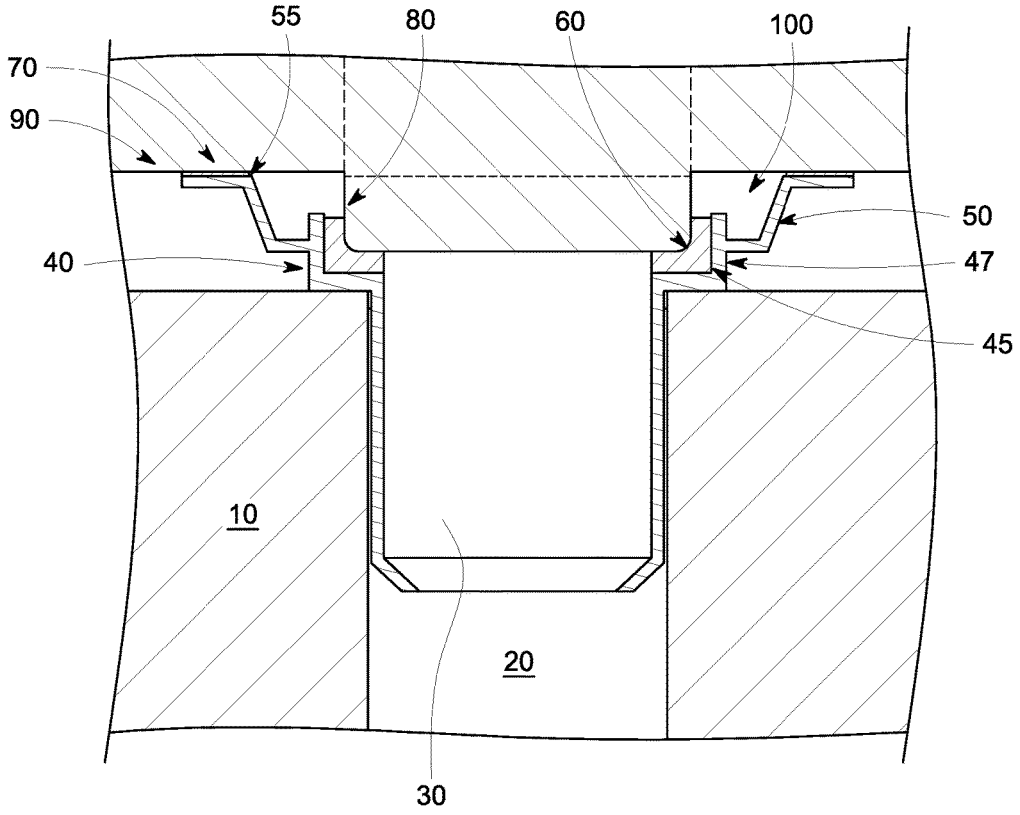
FIG. 5 depicts a cross sectional side view of an exemplary improved toilet seal as-installed between a toilet and flooring.

FIG. 5 presents another embodiment of the invention. It illustrates, in cross sectional fashion, the alternate embodiment of the invention as-installed between a toilet outlet 80 and a floor 10. This embodiment also incorporates a sleeve the distal portion 30 of which is inserted into the soil pipe 20 existing within the floor 10. The toilet outlet 80 engages a channel-shaped gasket 60 immediately above the distal portion of the sleeve 30. The channel-shaped gasket 60 can be made for a variety of elastomeric, adhesive, silicone, wax-like, rubber, or other pliable materials. The channel-shaped gasket 60 is disposed within an inner surface 45 of a first stage 40. Here, the inner surface 45 is oriented to specifically match the inner and outer diameter of toilet outlet 80. A second stage 50 extends from the outer surface 47 of the first stage. A ring-shaped gasket 70 is disposed on a top surface 55 of the second stage and self-adheres to a lower surface of the toilet 90. The ring-shaped gasket 70 can be made for a variety of elastomeric, adhesive, silicone, wax, cellulose, cork, rubber, and other pliable materials. This forms a chamber 100 between the channel-shaped gasket 60, the first stage 40, the second stage 50, the ring shaped gasket 70, and the lower surface of the toilet 90. The chamber 100 acts as a containment volume redundant to the contained volume existing between and through the soil pipe 20 and toilet. The appurtenances 110 allow screws, bolts, or other hardware components to connect the toilet lower surface 90 to the floor 10 or any intermediary installation means.

The invention's configuration is such that it may be used with any toilet having a circular outlet with which the first stage 40 and channel-shaped gasket 60 may be concentrically oriented, or with a specific toilet with an outlet having dimensions to completely sit within and abut the channel shaped gasket, creating a maximum seal. The channel-shaped gasket's shape 60 allows for it to be thinner than typical wax ring gaskets while providing a more secure seal. The ring-shaped gasket 70 bonds the top surface 55 of the second stage 50 to the toilet lower surface 90.

The invention solves leakage problems which arise from compromised seals because the invention is not dependent on the weight (or strength) of toilet or toilet anchor bolts in order to create a reliable seal at the toilet outlet. The channel-shaped gasket 60 allows flushed solid, liquid, and gaseous toilet contents to drain straight to the soil pipe 20. As illustrated in FIG. 1, the profile of the channel shaped gasket 60 adapts the invention to toilet outlets 80 of varying diameters. The distal portion of the sleeve 30 also helps to direct the flushed water into the soil pipe 20. The chamber 100 formed between the channel-shaped gasket 60, the second stage 50, the toilet outlet 80, and the lower surface of the toilet 90 creates a redundant barrier preventing solid, liquid, and gaseous toilet contents from leaking in the event the seal between the toilet outlet 80 and the channel-shaped gasket 60 is compromised.

I claim:

1. An improved toilet seal comprising:

cylindrical sleeve body, the cylindrical sleeve body having a distal end and a proximal end, the distal end adapted to being inserted into a soil pipe, the proximal end having a first stage radially extending from the distal end, the first stage having an inner surface and an outer surface;

a first gasket disposed onto the inner surface of the first stage, the gasket having a cross section that forms an angle of at least 90 degrees;

a second stage radially extending from the outer surface of the first stage, the second stage having a top surface;

a second gasket disposed onto the top surface of the second stage, the second gasket being self-adhesive, the second gasket adapted to be sealably bond to a lower surface of a toilet.

2. A method of installing an improved toilet seal between a soil pipe and a toilet, the method comprising:

producing an improved toilet seal, the improved toilet seal comprising a cylindrical sleeve body, the cylindrical sleeve body having a distal end and a proximal end, the distal end adapted to being inserted into a soil pipe, the proximal end having a first stage radially extending from the distal end, the first stage having an inner surface and an outer surface, a first gasket disposed onto the inner surface of the first stage, the gasket having a cross section that forms an angle of at least 90 degrees, a second stage radially extending from the outer surface of the first stage, the second stage having a top surface; a second gasket disposed onto the top surface of the second stage, the second gasket being self-adhesive, the second gasket adapted to be sealably bond to a lower surface of the toilet;

inserting the distal end of the cylindrical sleeve into the soil pipe until the floor abuts the first stage;

placing an outlet of the toilet onto the first gasket forming an enclosed volume from the soil pipe into the toilet; and sealably affixing the second gasket to the lower surface of the toilet forming an enclosed volume around the toilet outlet.

* * * * *